United States Patent [19]

Wilkinson

[11] Patent Number: 4,838,542

[45] Date of Patent: Jun. 13, 1989

[54] WRIST EXERCISE DEVICE

[75] Inventor: William T. Wilkinson, Chadds Ford, Pa.

[73] Assignee: Whatnot, Inc., Cleveland, Ohio

[21] Appl. No.: 196,296

[22] Filed: May 20, 1988

[51] Int. Cl.[4] ..... A63B 21/22; A63B 11/02

[52] U.S. Cl. ..... 272/67; 272/122; 272/132; 272/131

[58] Field of Search ..... 272/117, 122, 123, 131, 272/132, 127, 128, 67, 68, 135, 137, 140, 141, 142, 116

[56] References Cited

U.S. PATENT DOCUMENTS

| | | | |
|---|---|---|---|
| 3,184,234 | 5/1965 | Struble | 272/131 X |
| 3,656,267 | 5/1972 | McKinney | 272/67 |
| 3,856,297 | 12/1974 | Schnell | 272/132 X |
| 4,379,552 | 4/1983 | Webb et al. | 272/67 |
| 4,695,049 | 9/1987 | Ciemiega | 272/67 |
| 4,702,474 | 10/1987 | Guibert | 272/67 X |

*Primary Examiner*—Richard J. Apley
*Assistant Examiner*—David F. Crosby
*Attorney, Agent, or Firm*—Connolly & Hutz

[57] ABSTRACT

A wrist exercise device includes a hollow shaft having a turning disk rotatably mounted at one end thereof. Resistance is provided to oppose the rotation of the turning disk. A turning knob is secured at the opposite end of the shaft for setting the amount of the resistance. Detachable weights are mounted on the device so that the device also functions as a dumbbell.

11 Claims, 1 Drawing Sheet

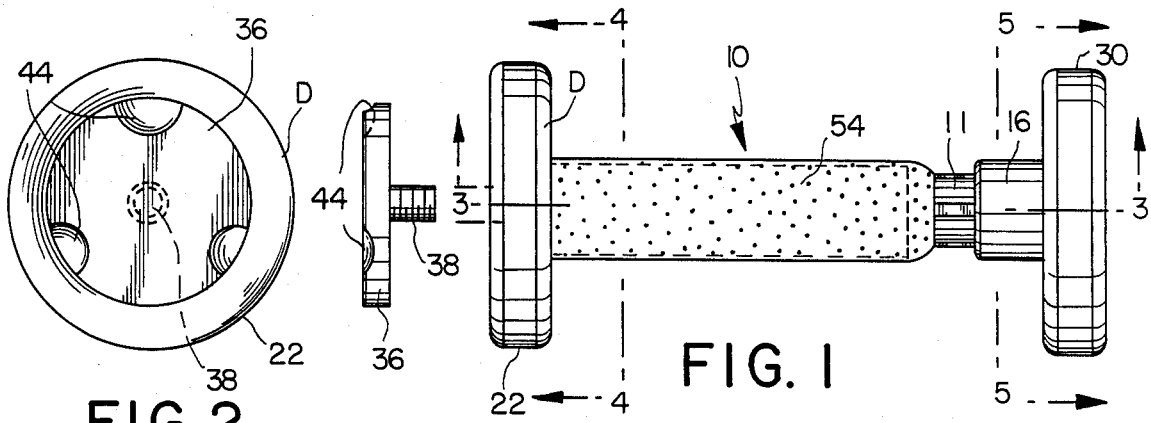
FIG. 2
FIG. 1
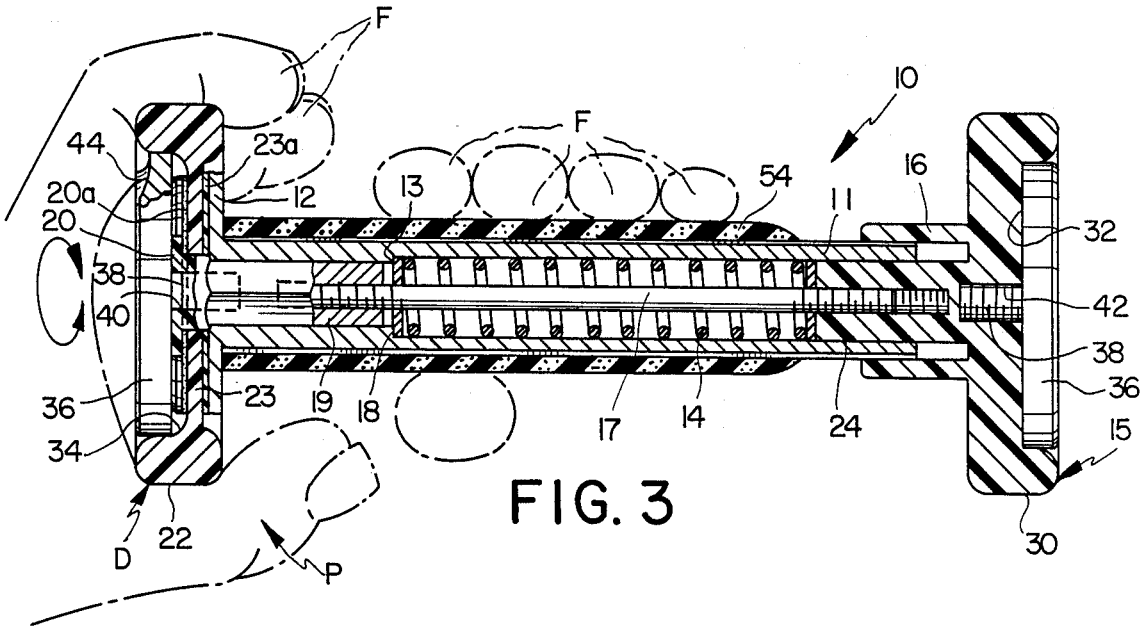
FIG. 3
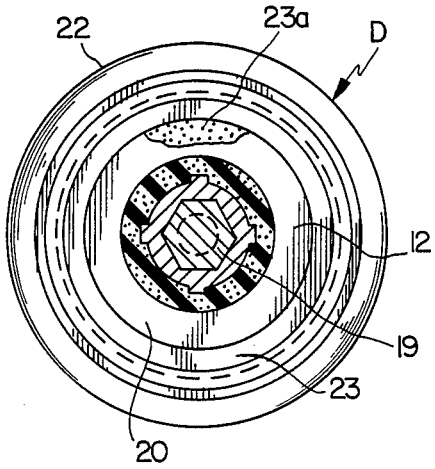
FIG. 4
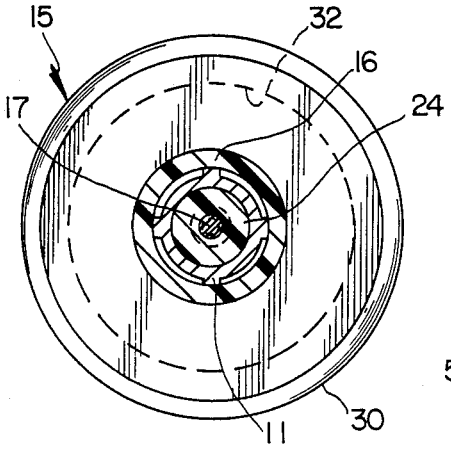
FIG. 5
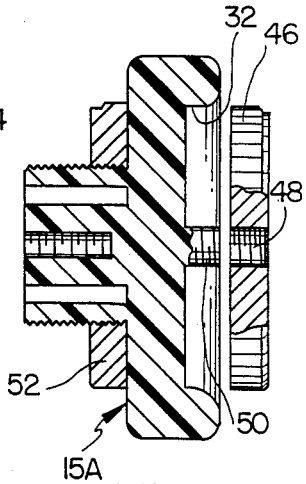
FIG. 6

WRIST EXERCISE DEVICE

BACKGROUND OF INVENTION

There is a growing consciousness for the need to exercise. Various devices exist for strengthening the hands, wrists and forearms using variable tension mechanisms. These devices range in degree of effectiveness. A particularly noteworthy device is disclosed in U.S. Pat. No. 3,666,267 which discloses a wrist exerciser in the form of a hollow shaft having a turning disk rotatably mounted at one end thereof with a turning knob at the other end for controlling the amount of resistance which opposes the rotational movement of the shaft. A spring is mounted within the shaft and leather disks are mounted in the turning disk to provide the resistance.

It would be desirable if a device such as the above noted wrist exerciser could be modified to preform other strengthening functions and not simply for strengthening the wrist.

SUMMARY OF INVENTION

An object of this invention is to provide a wrist exercise device which may also be used for strengthening the hand and forearm.

A further object of this invention is to provide such a device wherein the exercise program can be varied.

In accordance with this invention a wrist exercise device is provided along the lines of the aforenoted patent wherein a turning disk is mounted at one end of a hollow shaft and a turning knob is mounted at the other end. In accordance with this invention, however, detachable weights are secured to the turning disk so that the end of the device functions as a dumbbell. The turning knob is formed of a construction similar to the turning disk and also has detachable weights mounted thereto. In accordance with a further feature of this invention weights may be mounted on the shaft itself internally of, for example, the tension knob.

A non-slip sleeve may be mounted over the shaft to facilitate the user gripping the shaft. Additionally, the diameter of the shaft may be effectively varied in accordance with the thickness of the sleeve. Thus, if a larger diameter is desired for larger hands a thicker sleeve would be used.

THE DRAWINGS

FIG. 1 is a side elevation view of a wrist exercise device in accordance with this invention;

FIG. 2 is an end elevation view of the device of FIG. 1;

FIGS. 3, 4 and 5 are cross-sectional views taken through FIG. 1 along the lines 3—3, 4—4 and 5—5; and FIG. 6 is a cross-sectional view of a modified form of tension knob in accordance with this invention.

DETAILED DESCRIPTION

The present invention is concerned with modifying a wrist exercise device such as in U.S. Pat. No. 3,666,267, the details of which are incorporated herein by reference thereto. This modification of the wrist exercise device is such that the wrist exercise device is additionally converted into a dumbbell. Dumbbells are perhaps the most popular device in the fitness health exercise field. Thus, the invention combines both exercise devices into a single device. This permits the user to use the device as a dumbbell having variable or fixed weights or to develop both hand, wrist and forearm strength using the variable tension mechanism. FIGS. 1 and 3 illustrate the details of the wrist exercise device 10 which is based upon the principles of U.S. Pat. No. 3,666,267. As illustrated therein an elongated bar is adapted to receive the user's clenched hand by having the user's fingers F grasp the shaft while the second palm P of the user's other hand is at right angles to the first palm. A friction producing means carried between the shaft and the turning disk opposes a force exercised by the hands tending to turn the turning disk with respect to the shaft. Thus, the wrist of the clenched hand is exercised in a direction at right angles to the first palm, while the wrist of the other hand is exercised in the plane of the second palm.

As illustrated in FIGS. 1 and 3 the device 10 includes a hollow shaft or tubular sleeve 11 having a lower flange 12 integral therewith. Tubular sleeve 11 also has a seat portion 13 for receiving a disk 18 which accommodates a compression spring 14 at one end thereof. The spring 14 is confined by a cap or tension knob 15 which has a depending flange 16. The cap or tension knob 15 has an outer extension 16 and tension knob 15 carries a longitudinal shaft 17 which is threadably secured to an internal bore within a sleeve 19. The sleeve 19 is secured to an outer disk 20 carried integrally at right angles thereto.

The turning disk is a wheel having a rim 22 carried by a flat web 23. The web of the disk 20 and the web 23 carry leather portions **20*a* and 23*a***, respectively, and these associated parts form the friction producing means for the turning disk.

The compression spring 14 urges the shaft 17 upwardly, resiliently confining the web 23 between disk 20 and the flange 12. The leather portions **20*a* and 23*a* tend to produce a friction force tending to resist forces which would result in rotation between the tubular sleeve 11 and the turning disk D. By turning the tension knob 15 which is fixed to shaft 17 threadably engaged in hub 24 of tension knob 15, the threaded end of shaft 17 is turned to go further into or out of sleeve 19. Thus, the spring 14 is shortened or lengthened to increase or decrease the friction between the turning disk D and the tubular sleeve 11**.

The above description is based upon the wrist exerciser disclosed in U.S. Pat. No. 3,666,267. In accordance with this invention, however, the turning knob differs from the turning knob of that patent in that it is formed structurally similar to turning disk D. In this respect, turning knob 15 likewise includes an enlarged rim 30 similar to rim 22. Additionally, tension knob 15 has a recessed outer surface 32 similar to the recessed outer surface 34 of turning disk D.

As shown in FIGS. 1 and 3 a weight 36 is detachably mounted to turning disk D by threaded engagement of a central axle 38 in a threaded opening 40 in turning disk D. Similarly, tension knob 15 includes a threaded opening 42 for receiving a weight in its recess 32.

As shown in FIGS. 1 and 2 the outer surface of weight 36 has a plurality of finger detents 44 to permit the user to manipulate the weight 36 for mounting or unmounting the weight by rotating the weight to engage or disengage, as the case may be, the threaded shaft 38 from the threaded opening 40.

FIG. 6 illustrates an alternative form of tension knob 15A for the mounting of weights thereto. As shown therein, one variation includes having a weight 46 with an internally centrally located threaded opening 48 for threaded engagement with threaded projection 50 in recess 32.

FIG. 6 also illustrates a variation wherein the outer surface of flange 16 is provided with screw threads for thread engagement with a weight 52 which is in the form of a disk having an internally threaded central opening.

FIGS. 1 and 3 illustrate a further feature of this invention wherein a non-slip sleeve 54 is detachably mounted over hollow shaft 11. Sleeve 54 advantageously provides a gripping surface which facilitates the user's fingers F gripping the shaft portion of the device without slipping. Additionally, sleeve 54 permits the effective outer diameter of the shaft to be varied in accordance with the thickness of the sleeve.

Thus, device 10 provides circular resistance disks that turn and also become a weight by having two equally weighted disks, one at each end of shaft 11 the device 10 forms a balanced dumbbell. Additionally, by having the disks detachably mounted it is not necessary that the weights at each end of the device be equal and thus, by adding different types of weights device 10 may form a variable weight dumbbell.

The additional weights on the resistance turning disk D are preferably mounted inside the turning disk by being located in recess 34 so as not to interfere with the user placing his palm P around the turning diak. The additional weights at the opposite end, that is at the tension knob, can be mounted by being inserted in the recess 32 as shown in FIG. 3 or as shown in FIG. 6 or can be secured in any other manner such as nested in rim 30 or in other manners not shown such as simply clipping on to the tension knob. Moreover, the weights can be an integral part of the tension knob by having the tension knob molded as an integral part of the center of disk weight. Additionally, the weights can be mounted outside of the tension knob on an elongated bolt that runs through the hollow handle or shaft. The dumbbell can be of a given weight with weights permanently attached instead of having the weights detachably so as to be variable.

The present invention also contemplates modifying the wrist exerciser of U.S. Pat. No. 3,666,367. In this respect, with the wrist exerciser of that patent there is only a turning resistance wheel at one end. Thus, the wrist exerciser must be rotated or flipped 180° to exercise the hands from a different angle. With the present invention, it is possible to modify that device so that a resistance disk is provided at each end thereof, thus not requiring the device to be rotated. The hands would merely be moved to the right or to the left to alternate wrist angles. This is accomplished by duplicating the structures of the resistance disk at each end thereof since tension knob 15 is made of similar structure to turning disk D. In this embodiment the center shaft would be elongated until it extends through the center of the outside braking disk. It can fall short or extend beyond that disk. The tension knob would then be mounted on the end of this extended threaded center shaft and turned to apply pressure on the braking disk. This turning action draws the mechanism together and achieves the desired resistance.

Another feature of this invention is that it lends itself to be used by different hand sizes and to accommodate different gripping preferences. This can be achieved by the turning disks in different diameters or in having a large turning disk in which finger holes could be provided. Alternatively, a set of clip on rings could be used to increase or decrease the diameter of the turning disk. Further the outside edge of the turning disk could be grooved to provide turning holes. The center handle or shaft could be made of different diameter sizes or a set of non-slip sleeves, such as sleeve 54, could be used to vary the grip size.

What is claimed is:

1. In a wrist exercise device having a hollow shaft, a turning disk rotatably mounted at one end of said shaft, resistance means for providing a resistance force to oppose the rotation of said turning disk, a tension knob mounted to said shaft at the end of said shaft opposite said turning disk for controlling the amount of said resistance force, the improvement being in that weight means comprises at least one weight detachably mounted to at least one of said tension knob and said turning disk whereby said device additionally functions as a dumbbell.

2. The device of claim 1 wherein said tension knob is of generally the same diameter as said turning disk.

3. The device of claim 2 wherein each of said turning disk and said tension knob has weight means mounted thereto.

4. The device of claim 3 wherein the outer surface of each of said turning disk and said tension knob includes a recess, and said weight means comprises a weighted disk detachably mounted in each of said recess.

5. The device of claim 4 wherein each of said weighted disks is mounted in its recess by threaded means, and finger detents in an exposed surface of each of said weighted disks to facilitate the manipulation of said weighted disks.

6. The device of claim 5 including a non-slip sleeve detachably mounted over said shaft.

7. The device of claim 2 wherein said turning knob includes a depending annular flange around said shaft, and said weight means includes a weighted disk mounted to said flange.

8. The device of claim 7 wherein said weighted disk is secured to said flange by threaded means.

9. The device of claim 8 wherein the outer surface of said turning disk includes a recess, and said weight means includes a weighted disk mounted in said recess.

10. The device of claim 2 wherein the outer surface of said turning disk includes a recess, and said weight means includes a weighted disk mounted in said recess.

11. The device of claim 2 including a non-slip sleeve detachably mounted over said shaft.

* * * * *